US007174726B2

(12) United States Patent
Grau et al.

(10) Patent No.: US 7,174,726 B2
(45) Date of Patent: Feb. 13, 2007

(54) ADJUSTABLE NOZZLE DISTRIBUTOR

(75) Inventors: Jeffrey M. Grau, Fort Wayne, IN (US); Nazih Khatib, Ann Arbor, MI (US); Michael P. Wells, Bowling Green, OH (US)

(73) Assignee: Parker-Hannifin Corporation, Cleveland, OH (US)

( * ) Notice: Subject to any disclaimer, the term of this patent is extended or adjusted under 35 U.S.C. 154(b) by 144 days.

(21) Appl. No.: 10/913,861

(22) Filed: Aug. 6, 2004

(65) Prior Publication Data

US 2005/0028553 A1 Feb. 10, 2005

Related U.S. Application Data

(60) Provisional application No. 60/493,174, filed on Aug. 7, 2003.

(51) Int. Cl.
*F25B 1/00* (2006.01)

(52) U.S. Cl. ..... 62/115; 62/528

(58) Field of Classification Search ..... 62/504, 62/511, 525, 527, 528, 115; 138/45, 46; 251/58, 208, 209, 304
See application file for complete search history.

(56) References Cited

U.S. PATENT DOCUMENTS 2,960,845 A * 11/1960 Lange ..... 62/205
3,563,055 A * 2/1971 Owens ..... 62/525
3,795,259 A * 3/1974 Brandin et al. ..... 137/561 A
3,864,938 A 2/1975 Hayes, Jr.
4,516,606 A 5/1985 Worley
5,134,860 A 8/1992 Drucker
5,165,254 A * 11/1992 Kountz et al. ..... 62/324.6
5,213,135 A 5/1993 Moate
5,345,780 A * 9/1994 Aaron et al. ..... 62/324.6
5,402,821 A 4/1995 Harstad
5,600,962 A * 2/1997 Aizawa et al. ..... 62/204
5,689,972 A * 11/1997 Schuster et al. ..... 62/511
5,743,111 A * 4/1998 Sasaki et al. ..... 62/511
5,832,744 A 11/1998 Dorste et al.
5,937,658 A * 8/1999 Black et al. ..... 62/73
5,946,928 A * 9/1999 Wiggs ..... 62/260
6,023,940 A * 2/2000 Abbott et al. ..... 62/504
6,148,631 A * 11/2000 Watanabe et al. ..... 62/296
6,357,256 B1 * 3/2002 Mallek ..... 62/507
6,502,413 B2 * 1/2003 Repice et al. ..... 62/225
6,996,997 B2 * 2/2006 Wiff et al. ..... 62/127

FOREIGN PATENT DOCUMENTS

JP 2002-318031 A * 10/2002

* cited by examiner

*Primary Examiner*—Mohammad M. Ali
(74) *Attorney, Agent, or Firm*—Daniel J Whitman; Joseph J. Pophal

(57) ABSTRACT

A distributor, for use in a refrigerant system for conveying refrigerant between an expansion device and an evaporator, having a longitudinal body, an actuator, a plug, a first nozzle, and a second nozzle. The longitudinal body having a first end, a second end, a longitudinal passage between the first and second ends. The first nozzle being affixed within the passage. The second nozzle being rotatable within the passage for alignment and misalignment with the first nozzle. The second nozzle having a plurality of gear teeth engageable with the actuator, which is adjustable. A method of mixing refrigerant fluid while passing through the distributor.

31 Claims, 11 Drawing Sheets

ADJUSTABLE NOZZLE DISTRIBUTOR

CROSS-REFERENCE TO RELATED CASES

The present application claims the benefit of the filing date of U.S. Provisional Application Ser. No. 60/493,174 filed Aug. 7, 2003, the disclosure of which is incorporated herein by reference.

FIELD OF THE INVENTION

This invention relates generally to refrigerant and air-conditioning systems having a thermal expansion valve, an evaporator, and a distributor. More particularly, this invention relates to the distributor and improvements in the mixing and even distribution of stratified refrigerant fluids.

BACKGROUND OF THE INVENTION

Prior art designs of nozzle style refrigerant distributors for refrigeration and air-conditioning applications are well known. In a refrigeration system, the distributor is located downstream of the thermal expansion valve (TXV) and upstream of the evaporator. The purpose of the distributor is to evenly split the refrigerant fluid flow from the TXV into the many passages of a multi-circuited evaporator. The flow regime of the refrigerant flowing into the distributor is often a stratified two-phase (a layer of liquid and a layer of gas) fluid. This two-phase flow characteristic allows an uneven amount of gas and liquid to flow into the various circuits of the evaporator if a prior art manifold or header is used to split the flow.

The geometry of the prior art distributor ensures that the refrigerant flow is projected into a radially symmetrical cavity from which the feeder tubes (lines between the evaporator and distributor) emanate. Additionally, prior art distributors contain a plate (nozzle) with a thru-hole located in the center that increases the velocity of the stratified refrigerant flow. In this process, the pressure of the refrigerant fluid is decreased and the turbulent nature of the flow is increased. These effects are manifested in a more homogeneous (vs. stratified) flow regime that is more favorable for even distribution. However, these prior art designs rely on a correctly sized thru-hole (nozzle size) in the nozzle to be specified for each application. There are numerous variables that affect each application and the selection of the specific nozzle to be used. Some of these variables that influence the nozzle size selection are: the refrigerant type, the pressure of the evaporator, the level of subcooling of the refrigerant fluid entering the TXV, the evaporator temperature, the feeder tube diameter, the feeder tube length, etc. If the correct nozzle size is not installed into the distributor, the evaporator coil will demonstrate poor performance through either reduced capacity, system efficiency or a combination of both. A further obstacle with these style distributors is that the system must be "pumped down" and the distributor "un-brazed" from the system in order to replace the existing nozzle with one of appropriate size. This is a labor intensive process that can be expensive and costly.

The present invention overcomes these obstacles by providing a distributor where the effective nozzle size can be modulated over the range of nozzle sizes offered for a particular distributor. This eliminates the need to stock an entire range of individual nozzles. The present invention ensures that the nozzle size selection is not restricted to specific sizes. Rather, any effective size can be selected throughout the entire range. This allows further customization of the distributor to the application. The present invention allows for the adjustment of the nozzle size after the distributor has been installed (brazed) and while the system is running. This reduces the cost since the installation time is eliminating, a greater efficiency is established, and the cooling capacity is optimized.

SUMMARY OF THE PRESENT INVENTION

The invention provides a distributor for use in a refrigerant system for conveying refrigerant between an expansion device and an evaporator. The distributor is comprised of a body, at least one nozzle and an actuator. The body has a longitudinal axis with a first end, a second end and a through bore between the first end and the second end. The at least one nozzle is located within the through bore between the first and second ends. The actuator is in mating engagement with the at least one nozzle and is adjustable.

An aspect of the above noted distributor has the through bore being comprised of a longitudinal passage having a proximal portion located at the body first end, a midportion and a distal portion. The through bore also has a distribution chamber fluidly connected with the longitudinal passage and a plurality of discharge passages, each beginning at the distribution chamber and ending at the body second end. The longitudinal midportion houses the at least one nozzle. A further aspect of the noted distributor has the at least one nozzle being comprised of a first nozzle, having a central longitudinal through passage and at least one radially offset longitudinal through passage, and a second nozzle, having a central longitudinal through passage aligned with the first nozzle central longitudinal through passage and at least one radially offset longitudinal through passage.

Still another aspect of the noted distributor has the first nozzle being stationary and the second nozzle being incrementally rotatable from a beginning position, in which the second nozzle at least one radially offset passages are axially aligned with the first nozzle at least one radially offset passage, to an ending position, in which the second nozzle at least one radially offset passages are not aligned with the first nozzle at least one radially offset passages. Another feature of the noted distributor has the first and second nozzles being attached. Still another feature has the axial surface of the first nozzle sealingly abutting the axial surface of the second nozzle.

Another object of the noted distributor has the actuator being housed within a radial passage with a proximal end located at a radial surface of the body and a distal end terminating at the longitudinal passage midportion. Still another object of the noted distributor has the actuator with a plurality of gear teeth which engage a plurality of gear teeth on the second nozzle and an end accessible from the radial passage proximal end. Still yet another feature of the noted distributor has the actuator taking the form of a screw having a plurality of threads that engage with the plurality of gear teeth on the second nozzle and the actuator further has an end accessible from the radial passage proximal end. Still a further feature of the noted distributor has the radial passage being aligned with the axial center plane of the distributor body. Still another aspect of the noted distributor has the radial passage further housing a plug having a first engageable end and a second end in sealing contact with the distributor body.

Another feature of the noted distributor has the longitudinal passage distal end being defined by an inwardly directed annular wall. Still another feature of the noted distributor has the first and second nozzle radially offset passages generally at the same distance from the longitudinal axis of the body as the inwardly directed annular wall.

Still another feature of the noted distributor has the first nozzle having a central stub, with a hollow midportion, attachable with the second nozzle central through passage. Another feature of the noted distributor has the longitudinal proximal portion permanently receiving a tube.

The present invention further provides a method of mixing a fluid within a distributor, for use in a refrigerant system, located between an expansion device and an evaporator. The noted method comprises the steps of: receiving the fluid at a first end of the distributor; directing the fluid through a first longitudinal passage within the distributor body; directing the fluid through a first nozzle housed within the first longitudinal passage, having a central longitudinal passage and at least one radially offset longitudinal passage; directing and mixing the fluid through a second nozzle, housed within the first longitudinal passage, having a central longitudinal passage and at least one radially offset longitudinal passage; directing a portion of the mixed fluid into contact with an annular wall that defines the distributor body first longitudinal passage; and combining the mixed fluid portion with the remainder of the fluid and directing the combined mixed fluid into at least one discharge passage located within the distributor body. Further features and advantages of the present invention will become apparent to those skilled in the art upon review of the following specification in conjunction with the accompanying drawings.

DETAILED DESCRIPTION OF THE INVENTION

Figure 1:
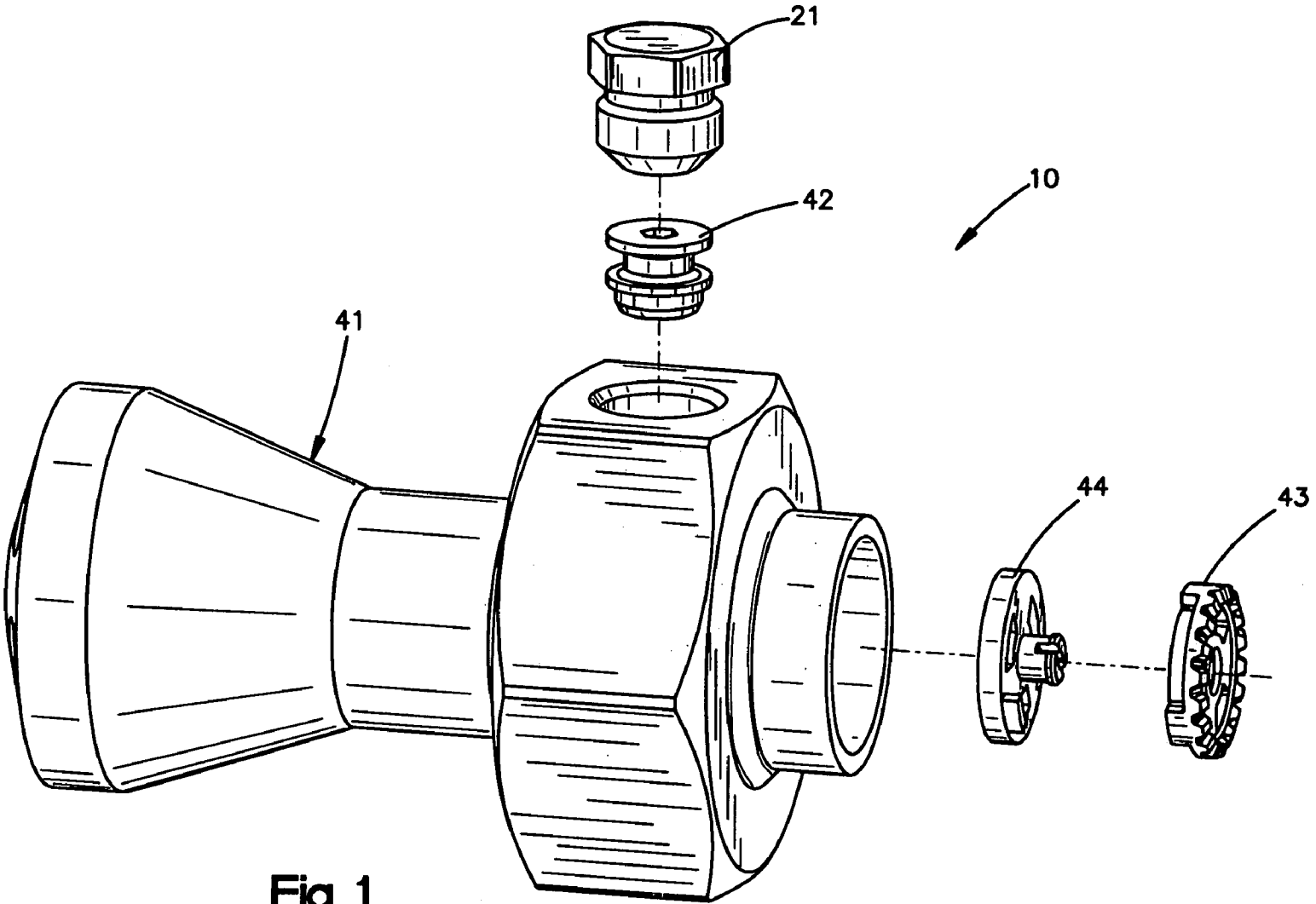
FIG. 1 is a perspective view of a distributor according to the present invention.
Figure 3:
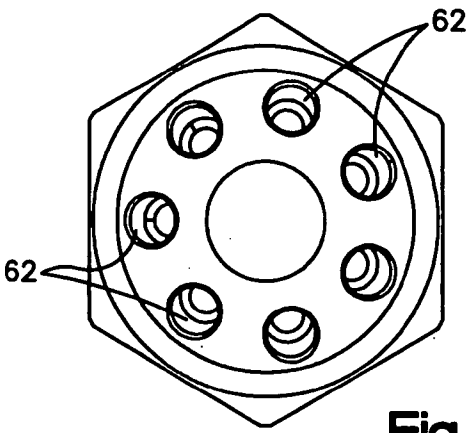
FIG. 3 is a frontal view of the distributor body.
Figure 2:
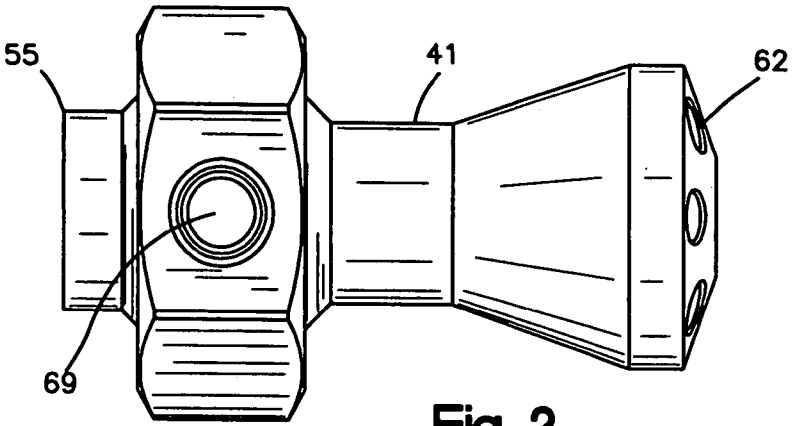
FIG. 2 is a side, elevational view of a distributor body, a component of the distributor shown in FIG. 1.
Figure 4:
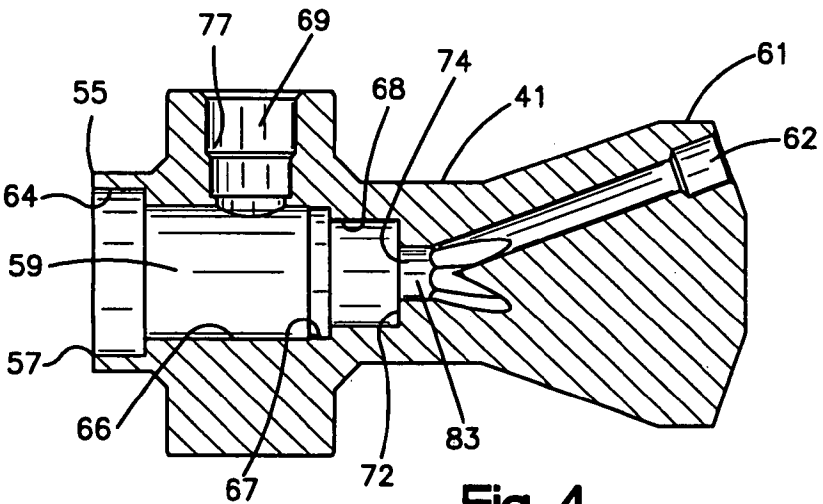
FIG. 4 is a longitudinal, cross-section view of the distributor body shown in FIG. 2.
Figure 6:
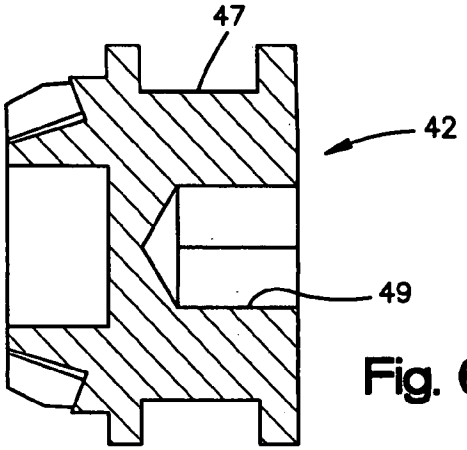
FIG. 6 is a longitudinal, cross-section view of the actuator shown in FIG. 5.
Figure 8:
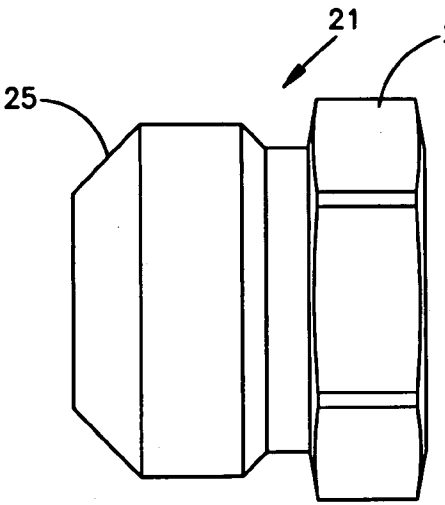
FIG. 8 is a side view of the plug, a component of the distributor shown in FIG. 1.
Figure 5:
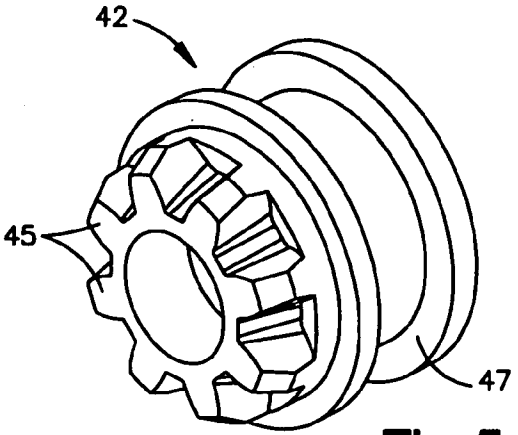
FIG. 5 is an elevational view of a actuator, a component of the distributor shown in FIG. 1.
Figure 7:
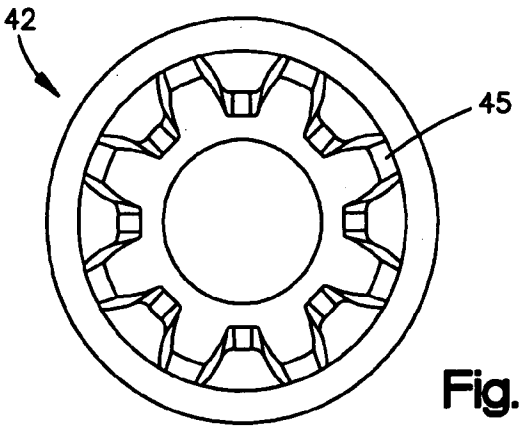
FIG. 7 is a frontal view of the actuator shown in FIG. 5.
Figure 10:
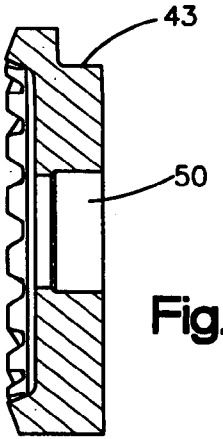
FIG. 10 is a side view, partly in section, of the geared nozzle shown in FIG. 9.
Figure 12:
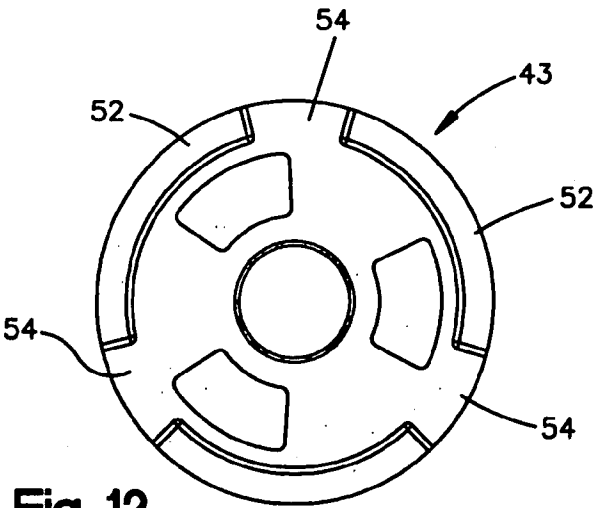
FIG. 12 is a rear view of the geared nozzle shown in FIG. 9.
Figure 9:
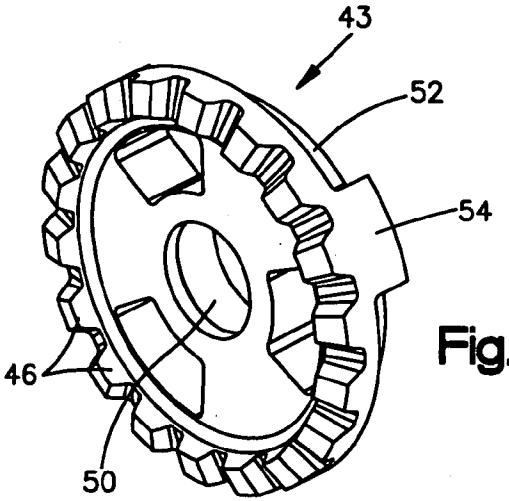
FIG. 9 is an elevational view of a geared nozzle, a component of the distributor shown in FIG. 1.
Figure 11:
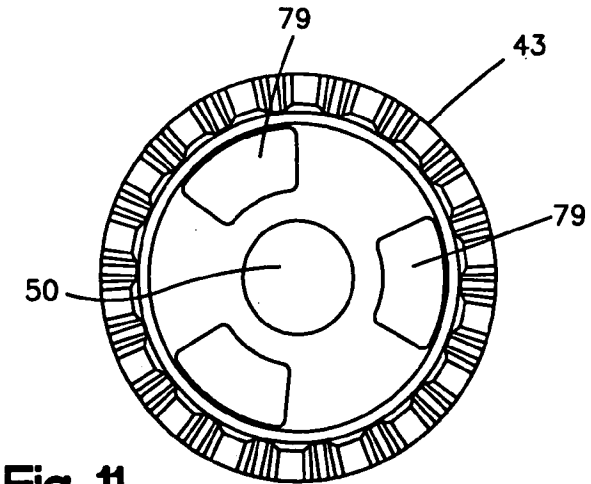
FIG. 11 is a frontal view of the geared nozzle shown in FIG. 9.
Figure 14:
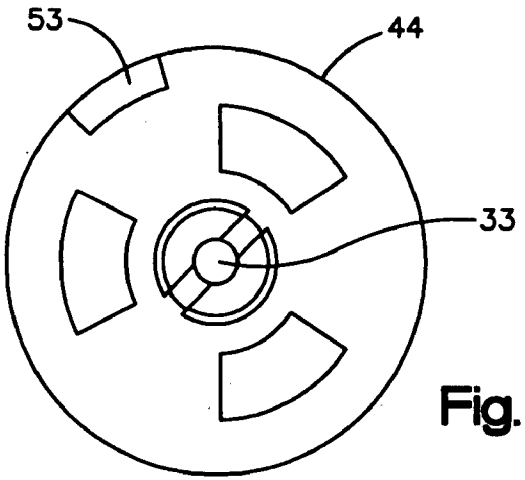
FIG. 14 is a frontal view of the stationary nozzle.
Figure 13:
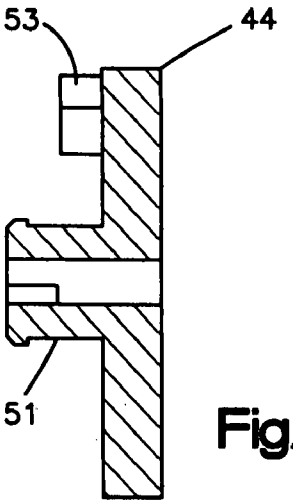
FIG. 13 is a longitudinal, cross-section view of a stationary nozzle, a component of the distributor shown in FIG. 1.
Figure 15:
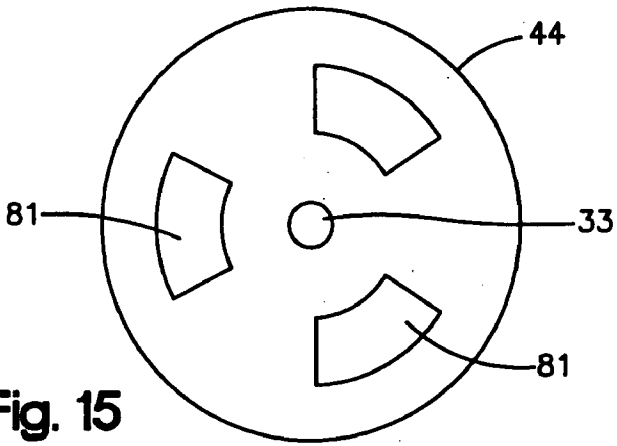
FIG. 15 is a rear view of the stationary nozzle.

Referring to FIG. 1, a distributor 10 according to the present invention is shown. Distributor 10 is comprised of a distributor body 41, an actuator 42, a geared nozzle 43, a stationary nozzle 44 and a plug 21. As is well known in the art, distributor 10 is located within a refrigerant system between a thermal expansion valve (not shown) and an evaporator (also not shown). Referring to FIGS. 1–4, distributor 10 receives refrigerant from the thermal expansion valve at a first end 55 of distributor body 41. The refrigerant is mixed within distributor body 41, as detailed below, and exits distributor body 41 at a second end 61 through a plurality of passages 62 that lead to the evaporator.

Distributor body first end 55 has an orifice 57 which leads to a longitudinal passage 59. Longitudinal passage 59 has three sections defined by differing diameters throughout its axial length. A first section 64 receives an inlet tube (not shown) through which two phase refrigerant flows into from the expansion valve. The inlet tube is permanently connected within first section 64. Longitudinal passage 59 has a second section 66 that receives geared nozzle 43 and stationary nozzle 44. Stationary nozzle 44 is located at a distal end 67 of second section 66 while geared nozzle 43 is aligned with a radial passage 69. Longitudinal passage 59 has a third section 68 with a distal end having an annular wall 72 and a central passage 74. Central passage 74 leads to the plurality of passages 62 which distribute the mixed refrigerant to the evaporator.

Referring to FIGS. 4 and 9–15, stationary nozzle 44 is permanently affixed, e.g. by press-fitting, with a specific orientation within longitudinal passage second section 66. Geared nozzle 43 is located within longitudinal passage second section 66 and is loosely joined to stationary nozzle 44. When assembled geared nozzle 43 can rotate relative to stationary nozzle 44, and has limited axial movement relative to stationary nozzle 44. Geared nozzle 43 has a centered hole 50 which receives an assembly stub 51 on stationary nozzle 44. Assembly stub 51 prevents geared nozzle 43 from moving completely axially away from stationary nozzle 44 while allowing limited axial movement. Geared nozzle 43 has a series of slots 52 which mate with a knob 53 which protrudes from an axial face on stationary nozzle 44. There are a series of stops 54 between each slot 52 that block further rotation of geared nozzle 43. These stops 54 are designed to follow industry valve common practice, which is: clockwise for reduced flow and counterclockwise for increased flow. That is, geared nozzle 43 can be rotated counterclockwise until stop 54 on geared nozzle 43 contacts knob 53 on stationary nozzle 44. Similarly, geared nozzle 43 can be rotated clockwise until another stop 54 contacts knob 53. As will be explained below, this rotation aligns nozzles 43, 44 so that maximum and minimum flow is achieved. Incremental movement of geared nozzle 43 provides incremental flow adjustment.

Stationary nozzle 44 has a center hole 33 that aligns with geared nozzle center hole 50 (when assembled) to allow the passage of fluid flow. Center hole 33 represents the smallest area for flow (or nozzle size) for distributor 10. Geared nozzle 43 has at least one auxiliary passage 79 radially offset from center hole 50. Similarly, stationary nozzle 44 has at least one auxiliary passage 81 radially offset from center hole 33. Both passages 79, 81 axially extend through their respective nozzles 43, 44. Auxiliary passages 81 on stationary nozzle 44 and auxiliary passages 79 on geared nozzle 43 can be completely aligned to allow a maximum flow, for controlling the mixing of the fluid, through distributor 10. This occurs when geared nozzle is completely rotated counterclockwise. Complete alignment of nozzle passages provides the equivalent of the largest nozzle size required by distributor 10. Similarly, auxiliary passages 79, 81 can be completely misaligned to restrict flow to only center holes 33, 50. This occurs when geared nozzle 43 is completely rotated clockwise. Additionally, auxiliary passages 79, 81 can be aligned to influence the amount of mixing for any desired flow rate. This incremental alignment of passages 79, 81 provides a substitute for the entire range of nozzle sizes to be emulated. Since the alignment/misalignment of passages 79, 81 is done on nozzles 44, 43 (which are not changed out), an enduser need not substitute nozzles for a desired flow. This greatly reduces the inventory needed. It also greatly reduces the time needed to provide for the appropriate amount of mixing for the desired flow.

Geared nozzle 43 has a plurality of teeth 46 that are positioned to face and mate with actuator 42. Gear teeth 46 mesh with teeth 45 on actuator 42 so its rotation results in rotation of geared nozzle 43. The engagement of the gear teeth and the orientation of stationary nozzle 44 are designed so that the rotation of actuator 42 in one direction is halted in the complete misalignment of auxiliary passages 79, 81. Similarly, the design is such that rotation of actuator 42 in the opposite direction is halted in the full alignment of auxiliary passages 79, 81. The thrust from the refrigerant flow compresses geared nozzle 43 against stationary nozzle 44 providing a seal against unwanted refrigerant flow past the combination of nozzles 43, 44.

Radial passage 69 houses actuator 42 and plug 21. Referring to FIGS. 5–8, gear teeth 45 of actuator 42 are located at one longitudinal end and mate with gear teeth 46 on geared nozzle 43. When properly assembled within radial passage 69, gear teeth 45 face towards longitudinal passage 59. Actuator 42 has an O-ring gland 47 (O-ring not shown) that seals against distributor body 41 in radial passage 69. Actuator 42 has a hexagonal cavity 49 on the longitudinal end opposite gear teeth 45. When assembled within radial passage 69, hexagonal cavity 49 faces outwardly. Hexagonal cavity 49 is shaped to matingly receive a hex wrench so that it can be manually rotated. Actuator 42 can be held within radial passage 69 through deformation of the material on distributor body 41, a retaining ring (not shown), or other common methods. Plug 21 is also located within radial passage 69 and is positioned radially outwardly of actuator 42. Plug 21 is attached, e.g. with a threaded attachment, within radial passage 69 and has an end 23 that is accessible to the end user. End 23 can have a hexagonal shape so that the end user can fasten and remove plug 21 with a wrench. Plug 21 has a circumferential sealing surface 25 on the axial end opposite end 23 that seals against a sharp corner 77 within radial passage 69.

Referring to FIGS. 1, 4, 11, and 14, during operation, a two-phase refrigerant from the expansion device (not shown) flows into distributor body 41 through the permanently attached inlet tube (not shown) which is connected (e.g. by brazing) into distributor body first section 64. The two-phase refrigerant flow is then mixed when it flows through passages 79, 81 on geared and stationary nozzles 43, 44 which have been appropriately aligned for the application. It should be noted that when the refrigerant flows first flows through geared nozzle 43, the force of the flow can axially move geared nozzle 43 into close abutment with stationary nozzle 44. This prevents fluid from leaking past the first geared nozzle 43 and then past stationary nozzle 44 and only allows the fluid to pass through center holes and auxiliary passages. The mixed refrigerant fluid flow is directed to strike annular wall 72 of distributor body 41. After hitting annular wall 72, the mixed fluid flow is realigned, or refocused, to join the fluid flow passing through stationary nozzle center through hole 33. This combined flow enters into a distribution chamber 83 and splits into the plurality of passages 62. Feeder tubes (not shown) are permanently attached to passages 62. The mixed refrigerant is then conveyed through the feeder tubes into the many circuits of the evaporator (not shown). It is important to note that the refrigerant flow through auxiliary holes 79, 81 on stationary and geared nozzles 44, 43 is directed onto annular wall 72 before joining the refrigerant flow through the center. Auxiliary passages 79, 81 are radially aligned with annular wall 72 so that the flow is directed to contact wall 72.

Distributor 10 has overcome manufacturing and assembling obstacles of the prior art. Since actuator 42 acts as a gear, radial passage 69 can be machined centrally (best seen in FIG. 2), which provides a cost effective machining method. The ability to assemble stationary and geared nozzles 44, 43 outside of distributor body 41 greatly facilitates assembly. The design of stub 51 and slots 52 eliminates the possibility for incorrect assembly of stationary nozzle 44 to geared nozzle 43. It also removes any requirement for alignment of auxiliary holes 79, 81 within distributor body 41 and gear teeth 46 on geared nozzle 43.

FIGS. 16–26 detail another embodiment of the present invention. The main features and components of this embodiment are the same as that shown above with distributor 10. These commonalities will not be detailed again and will be referenced with element numbers that have a "1" as a prefix, and the same digits following the "1" as in the embodiment discussed above. The differences between this embodiment and that shown above with distributor 10 are in the nozzles, the actuating means and the position of the actuating means.

Figure 16:
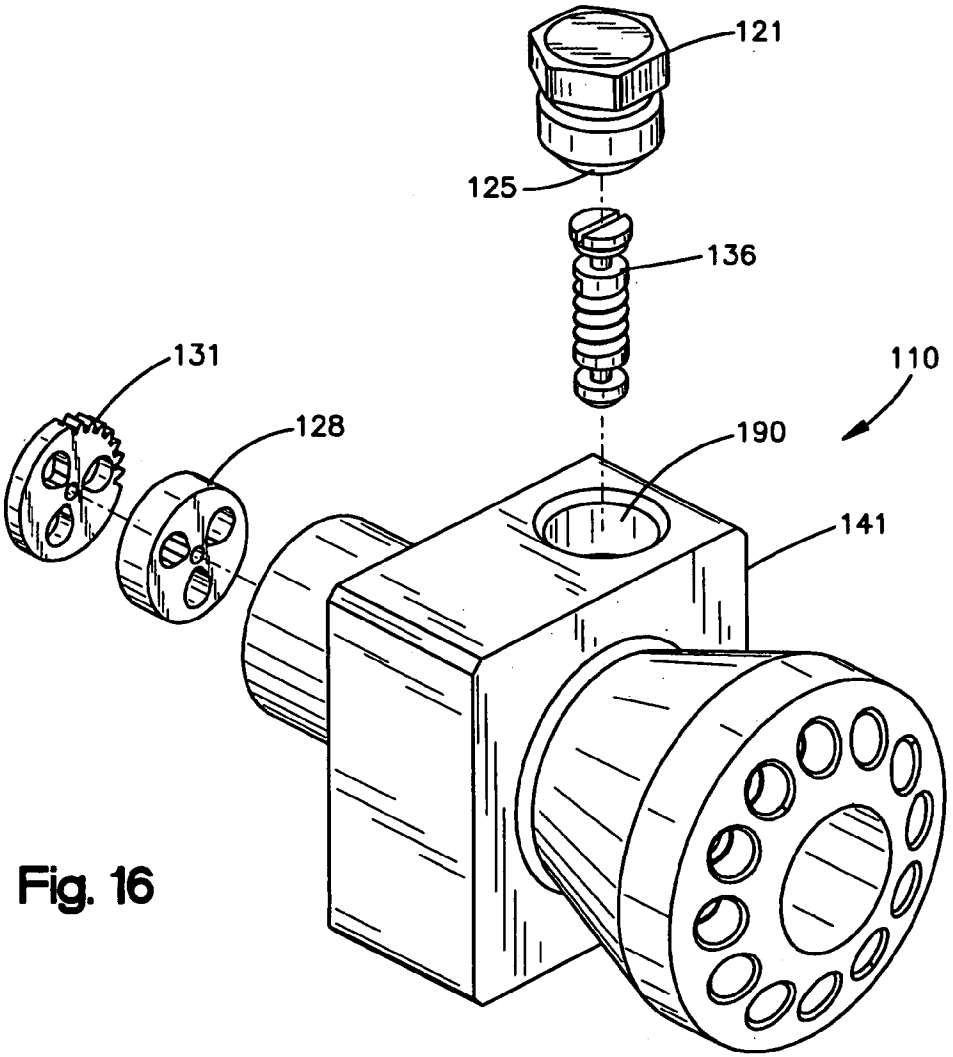
FIG. 16 is a perspective view of another embodiment of a distributor according to the present invention.
Figure 18:
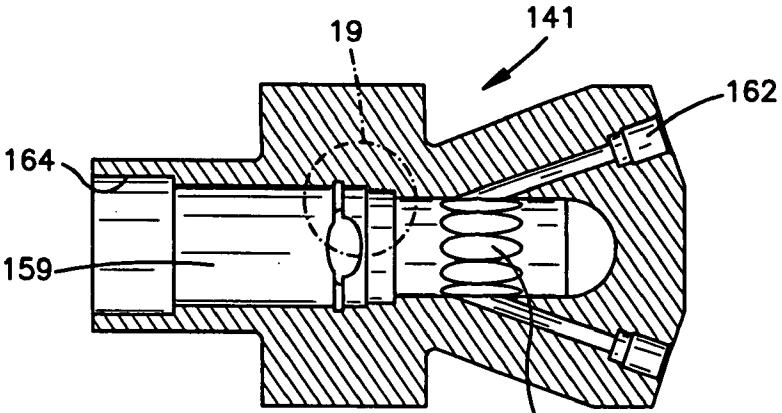
FIG. 18 is a longitudinal, cross-section view of the distributor body shown in FIG. 17.
Figure 17:
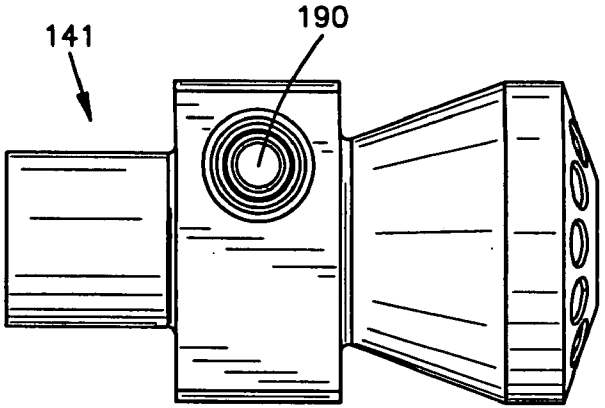
FIG. 17 is a side view of the distributor body, a component of the distributor shown in FIG. 16.
Figure 21:
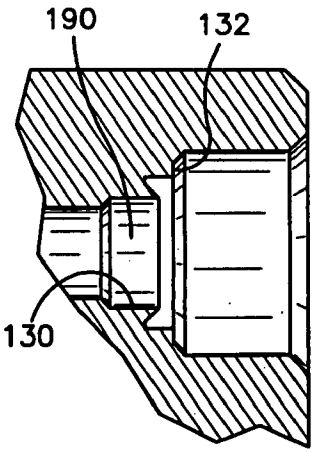
FIG. 21 is an enlarged, detailed sectional view of a portion of the distributor body shown in FIG. 20.
Figure 20:
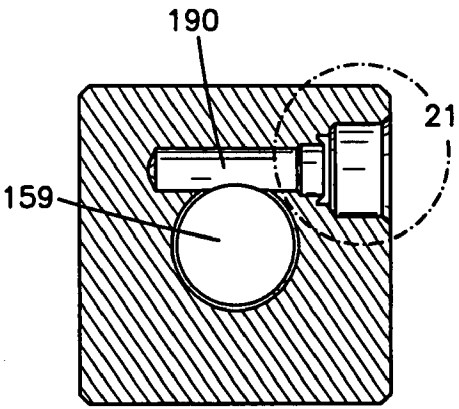
FIG. 20 is a radial, cross-section view of the distributor body shown in FIG. 17.
Figure 19:
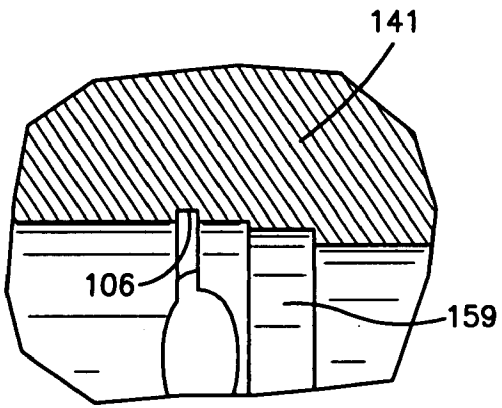
FIG. 19 is an enlarged, detailed sectional view of a portion of the distributor body shown in FIG. 18.
Figure 23:
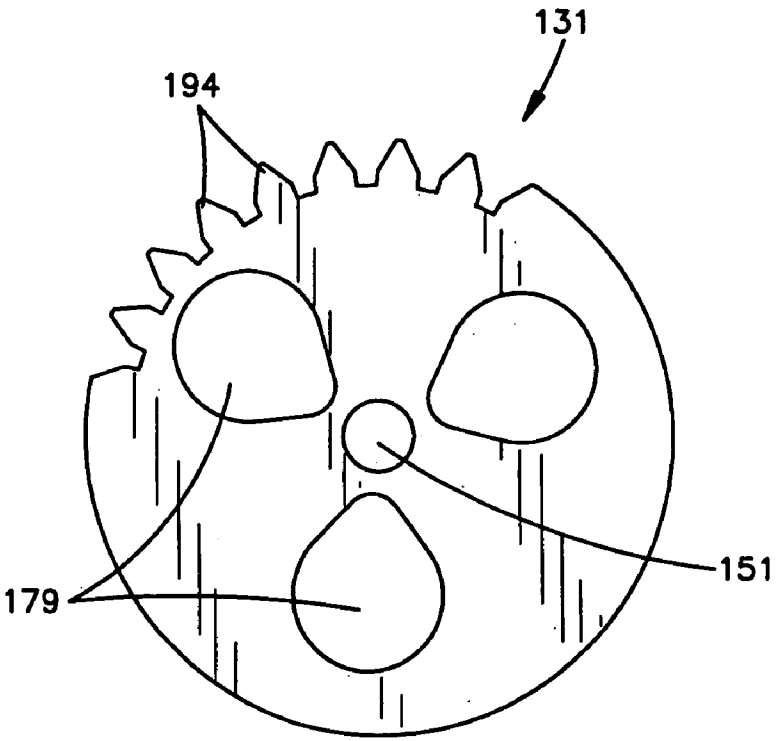
FIG. 23 is a frontal view of the geared nozzle, a component of the distributor shown in FIG. 16.
Figure 22:
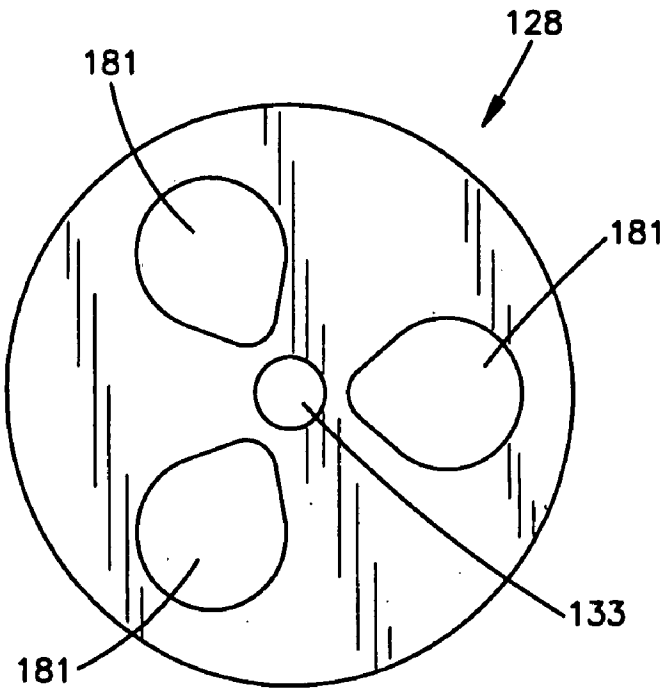
FIG. 22 is a frontal view of the stationary nozzle, a component of the distributor shown in FIG. 16.
Figure 25:
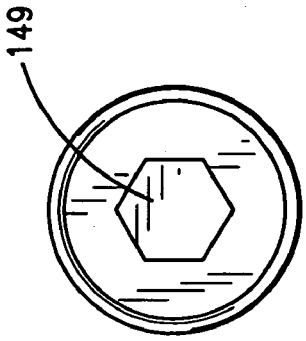
FIG. 25 is a rear view of the actuator shown in FIG. 24.
Figure 26:
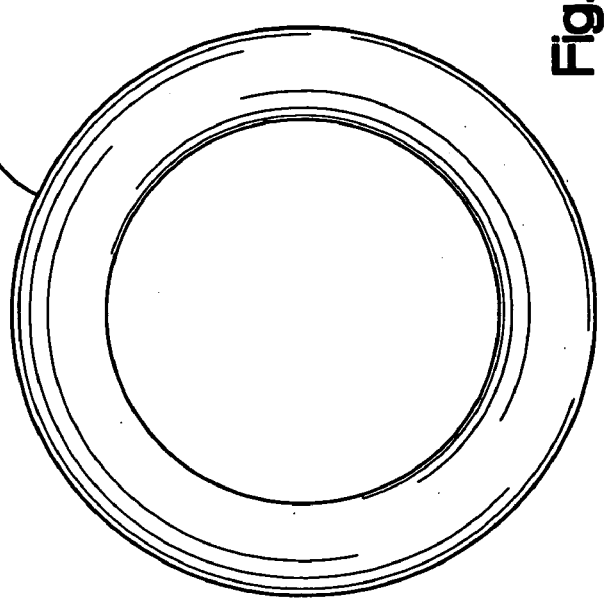
FIG. 26 is a frontal view of a seal, which is housed on the actuator shown in FIG. 24.
Figure 24:
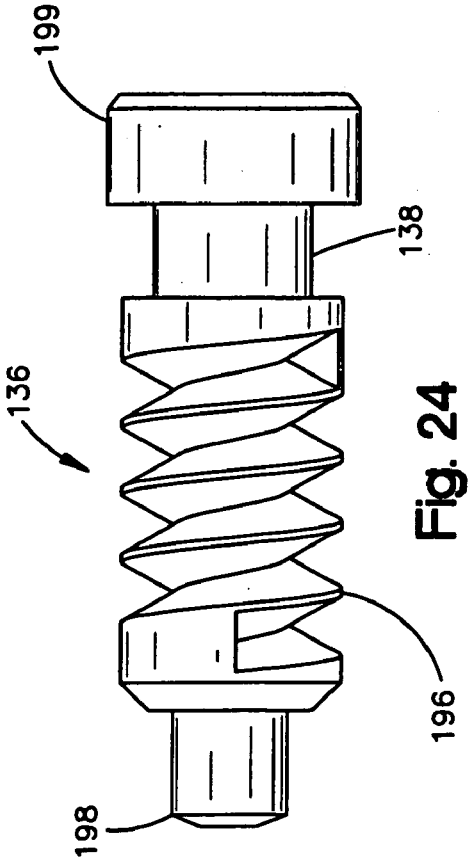
FIG. 24 is a side view of the actuator, a component of the distributor shown in FIG. 16.

FIG. 16 shows a distributor 10 having a distributor body 141, a stationary nozzle 128, a geared nozzle 131, an actuation screw 136, and a plug 121. Stationary nozzle 128 is again press-fit with a specific orientation within longitudinal passage 159 in distributor body 141. Geared nozzle 131 is again located within longitudinal passage 159 and is held in place with a retaining ring (not shown) located in a cavity 106 of distributor body 141. Geared nozzle 131 has a plurality of gear teeth 194 located on its outer radial surface. Geared nozzle 131 is oriented so that gear teeth 194 are directed toward a radial passage 190. Radial passage 190 houses actuation screw 136 and plug 121. Actuation screw 136 is held within radial passage 190 through permanent deformation of material (at location 130) of distributor body 141. Plug 121 is located within radial passage 190 and is threadedly attached so its sealing surface 125 seals against sharp corner 132.

Actuation screw 136 has a first longitudinal end 198 and a second longitudinal end 199. Screw 136 has a series of external threads, or gear teeth, 196 located between first and second longitudinal ends 198, 199. Actuation screw 136 has a groove 138, located between threads 196 and second longitudinal end 199, that receives a seal 139. Screw 136 has a cavity, such as a hexagonal cavity 149, located in the axial end surface of second longitudinal end 199 that is designed to receive a tool for rotating screw 136.

Stationary nozzle 128 and geared nozzle 131 each have a center hole (133 and 151, respectively) in the center of each nozzle. Center holes 133, 151 are always aligned to allow flow and represent the smallest nozzle size necessary for distributor 110. Stationary nozzle has at least one auxiliary hole 181 radially offset from center hole 133. Geared nozzle also has at least one auxiliary hole 179 radially offset from center hole 151. Auxiliary holes 181, 179 can be completely aligned to allow a flow equivalent to the largest nozzle size required by distributor 110. Similarly, auxiliary holes 181, 179 can be completely misaligned to restrict flow to only center holes 133, 151. Additionally, auxiliary holes 181, 179 can be partially aligned to allow for any flow rate for the entire range of nozzle sizes to be emulated.

Gear teeth 194 on geared nozzle 131 are designed to mesh with actuator screw threads 196 so that rotation of actuator screw 136 results in rotation of geared nozzle 131 much like a worm gear. Gear teeth 194, threads 196, and the orientation of stationary nozzle 128 are designed so that the rotation of actuation screw 136 in one direction is halted in the complete misalignment of auxiliary holes 179, 181. Similarly, the design is such that rotation of actuation screw 136 in the opposite direction is halted in the full alignment of auxiliary holes 179, 181. Again, the thrust from the refrigerant flow presses geared nozzle 131 against stationary nozzle 128 providing a seal against unwanted refrigerant flow past the combination of nozzles 131, 128.

Similar to that previously described, during operation, the two-phase refrigerant from the expansion device (not shown) flows into distributor body 141 through a permanently attached inlet tube (not shown) which is brazed into a first section 164 of longitudinal passage 159. The flow is then mixed through auxiliary holes 179, 181 on geared nozzle 131 and stationary nozzle 128 which have been appropriately aligned. The mixed fluid flows into a distribution chamber 183 and splits into at least one feeder tube passages 162 to which feeder tubes (not shown) are permanently attached. Refrigerant is then conveyed through the feeder tubes and into the many circuits of the evaporator (not shown).

Figure 27:
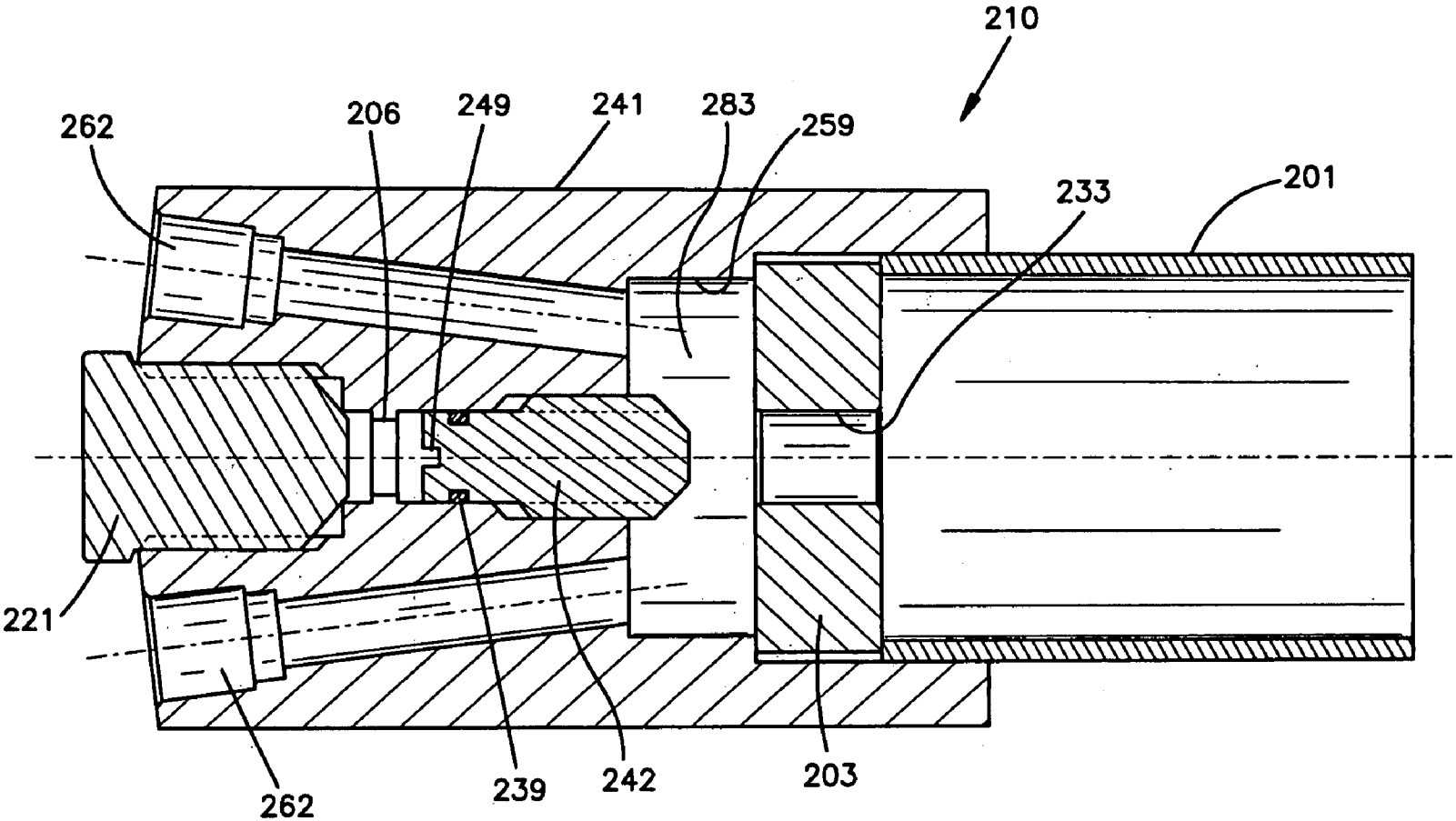
FIG. 27 is a longitudinal, cross-section view of a further embodiment of a distributor according to the present invention.

FIG. 27 details another embodiment of the present invention. Distributor 210 is comprised of a distributor body 241, a nozzle 203, an actuator 242, and a plug 221. Some of the features and components of this embodiment are the same as that shown in the embodiments discussed above. Again, the similarities will not be discussed in detail and will be referenced with element numbers that have a "2" as a prefix, with the same digits following the "2" as in the embodiments discussed above.

An inlet tube 201, through which two phase refrigerant flows into from an expansion valve (not shown) is permanently connected to the distributor body 241. The refrigerant flows through a thru-hole 233 of nozzle 203. Nozzle 203 is housed within a longitudinal passage 259 located in distributor body 241. Thru-hole 233 of nozzle 203 is concentric with the longitudinal axis of distributor body 241. The two-phase refrigerant is tumbled as it passes through nozzle 203 into a distribution chamber 283. From distribution chamber 283 the flow is split into a plurality of feeder tube passages 262. Feeder tubes (not shown) are permanently attached to passages 262 of distributor body 241. As is well known in the art and discussed above, these feeder tubes connect distributor 210 to the many circuits of the evaporator (not shown).

The effective flow area through nozzle 203 can be modulated by the axial movement (and distance) of actuator 242 into and away from nozzle 203. Actuator 242 is adjustably connected within distributor body 241 and can be axially moved so that it abuts nozzle 203. Actuator 242 can be incrementally adjusted so that it is axially removed from nozzle 203 any desired axial distance. A notch, or cavity, 242 in the axial end surface of actuator 242 allows for adjustment (e.g. with a tool) by the enduser. Adjustment can be made while the system is operating. Material from distributor body 241 is staked, at 206, inwardly so that actuator 242 is prevented from moving out of distributor body 241. This retains actuator 242 within distributor body 241 while under positive pressure from the refrigerant. Actuator 242 also houses a seal 239 which prevents leakage of refrigerant out of distributor body 241. A final metal-to-metal seal is provided by plug 221 which is threadedly attached within distributor body 241.

Figure 28:
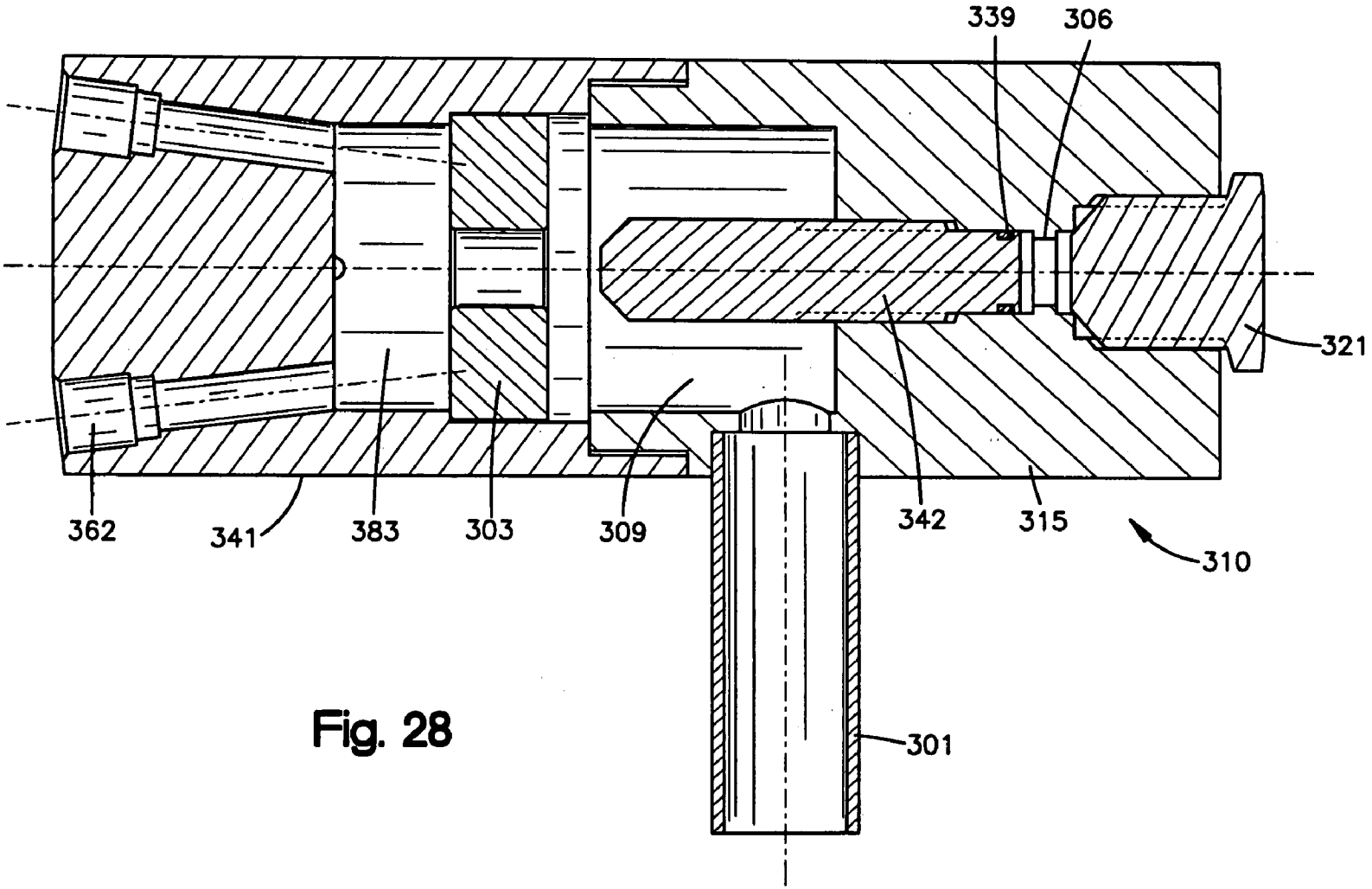
FIG. 28 is a longitudinal, cross-section view of yet another embodiment of a distributor according to the present invention.

FIG. 28 details yet another embodiment of the present invention. Distributor 310 is comprised of a distributor body 341, a valve body 315, a nozzle 303, an actuator 342, and a plug 321. Some of the features and components of this embodiment are the same as that shown in the embodiments discussed above. Again, the similarities will not be discussed in detail and will be referenced with element numbers that have a "3" as a prefix, with the same digits following the "3" as in the embodiments discussed above.

Valve body 315 and distributor body 341 are permanently connected (e.g. brazed) to each other. Distributor 310 has an inlet tube 301 permanently attached to valve body 315. Two-phase refrigerant enters the inlet tube 301 from the expansion device and flows into a valve body chamber 309. The refrigerant is then mixed as it passes through nozzle 303 and into a distribution chamber 383. The refrigerant then flows through a plurality of feeder tube passages 362 and into the feeder tubes (not shown) which connect the distributor body 341 to the many circuits of the evaporator (not shown). The effective flow area through nozzle 303 is modulated by the extension and retraction of actuator 342 into and out of nozzle 303 by means of thread rotation. Again, actuator 342 is prevented from leaving valve body 315 by staking material, at 306, of valve body 315. Leakage is prevented through the use of a seal 339. A final seal is provided with threaded plug 321.

It should be restated that the present invention offers advantages over the existing art. The distributor(s) of this invention eliminate the need to stock an entire range of individual nozzles. In the prior art, specific replacement nozzles, having a set flow-thru area, are needed for each application. The present design allows the effective nozzle size to be modulated over the range of nozzle sizes offered for a particular distributor. This eliminates the need to stock an entire range of individual nozzles. Further, the nozzle size selection is not restricted to specific sizes. Rather, any effective size can be selected throughout the entire range. This allows further customization of the distributor to the application. Also, the nozzle size can be adjusted after the distributor has been installed, and brazed and while the system is running. This reduces the cost and installation time while improving the efficiency and cooling capacity of the system.

It should be noted that the present invention is not limited to the specified preferred embodiments and principles. Those skilled in the art to which this invention pertains may formulate modifications and alterations to the present invention. These changes, which rely upon the teachings by which this disclosure has advanced, are properly considered within the scope of this invention as defined by the appended claims.

What is claimed is:

1. A distributor for use in a refrigerant system for conveying refrigerant between an expansion device and an evaporator comprising:

a body having a longitudinal axis with a first end, a second end, and a through bore between said first end and said second end;

at least one nozzle located within said through bore between said first end and said second end; and an actuator in mating engagement with said at least one nozzle, wherein said at least one nozzle includes a central through passage and at least one radial offset through passage, said at least one nozzle being movable by said actuator for adjusting refrigerant flow through said at least one radial offset through passage.

2. The distributor as in claim 1 wherein said through bore is comprised of:

a longitudinal passage having a proximal portion located at said body first end, a mid portion and a distal portion;

a distribution chamber fluidly connected with said longitudinal passage; and a plurality of discharge passages, each beginning at said distribution chamber and ending at said body second end.

3. A distributor for use in a refrigerant system for conveying refrigerant between an expansion device and an evaporator comprising:

a body having a longitudinal axis with a first end, a second end, and through bore between said first end and said second end;

at least one nozzle located within said through bore between said first end and said second end; and an actuator in mating engagement with said at least one nozzle, wherein said at least one nozzle is adjustable and said through bore is comprised of a longitudinal passage having a proximal portion located at said body first end, a midportion and a distal portion, a distribution chamber fluidly connected with said longitudinal passage, and a plurality of discharge passages, each beginning at said distribution chamber and ending at said body second end, wherein said longitudinal passage midportion houses said at least one nozzle which are comprised of:

a first nozzle having a central longitudinal through passage and at least one radially offset longitudinal through passage; and a second nozzle having a central longitudinal through passage aligned with said first nozzle central longitudinal passage and at least one radially offset longitudinal through passage.

4. The distributor as in claim 3 wherein said first nozzle is stationary and said second nozzle is incrementally rotatable from a beginning position in which said second nozzle at least one radially offset passages are axially aligned with said first nozzle at least one radially offset passage to an ending position in which said second nozzle at least one radially offset passages are misaligned with said first nozzle at least one radially offset passages.

5. The distributor as in claim 4 wherein said first and second nozzles are attached.

6. The distributor as in claim 4 wherein said first nozzle has an axial surface which sealingly abuts an axial surface of said second nozzle.

7. The distributor as in claim 4 in which said actuator is housed within a radial passage having a proximal end located at a radial surface of said body and a distal end terminating at said longitudinal passage midportion.

8. The distributor as in claim 7 wherein said actuator has a plurality of gear teeth which engage a plurality of gear teeth on said second nozzle and said actuator further has an end accessible from said radial passage proximal end.

9. The distributor as in claim 7 wherein said actuator takes the form of a screw having a plurality of threads that engage with a plurality of gear teeth on said second nozzle and said actuator further has an end accessible from said radial passage proximal end.

10. The distributor as in claim 7 wherein said radial passage is aligned with the axial center plane of said distributor body.

11. The distributor as in claim 7 wherein said radial passage further houses a plug having a first engageable end and a second end in sealing contact with said distributor body.

12. The distributor as in claim 3 wherein said longitudinal passage distal portion is defined by an inwardly directed annular wall.

13. The distributor as in claim 3 wherein said first and second nozzle radially offset passages are generally the same distance from the longitudinal axis of said body as said inwardly directed annular wall.

14. The distributor as in claim 3 wherein said first nozzle has a central stub, with a hollow midportion, protruding from an axial face, said central stub being attachedly received by said second nozzle central through passage.

15. The distributor as in claim 3 wherein a tube is permanently received within said longitudinal passage proximal portion.

16. The distributor as in claim 3 wherein said second nozzle is axially moveable from a first position in which an axial surface of said second nozzle sealingly abuts an axial surface of said first nozzle to a second position in which said second nozzle is axially removed from said first nozzle.

17. A distributor for use in a refrigerant system for conveying refrigerant between an expansion device and an evaporator comprising:

a longitudinal body having:

a first end;

a second end;

a first longitudinal passage having a proximal end located at said body first end and a distal end located between said body first and second ends, said distal end having an inwardly directed annular shoulder;

a distribution chamber fluidly connected with said first longitudinal passage distal end;

a radial passage having a proximal end located at a radial surface of said body and a distal end terminating into said first longitudinal passage; and at least one discharge passage having a proximal end fluidly connected with said distribution chamber and a distal end located at said body second end;

an actuator located within said radial passage, having a first adjustable end and a second end;

a plug located within said radial passage, having a first end located at said radial passage proximal end and being engageable;

a first nozzle located within said first longitudinal passage, having a central longitudinal passage and at least one radially offset longitudinal passage extending therethrough; and a second nozzle located within said first longitudinal passage, in mating contact with said actuator, having a central longitudinal passage aligned with said first nozzle central longitudinal passage and at least one radially offset longitudinal passage extending therethrough, rotatable from a first position in which said first nozzle at least one radially offset longitudinal passage is axially aligned with said second nozzle at least one radially offset longitudinal passage to a second position in which said first nozzle at least one radially offset longitudinal passage is misaligned with said second nozzle at least one radially offset longitudinal passage.

18. The distributor as in claim 17 wherein said first and second nozzles are attached.

19. The distributor as in claim 17 wherein said first nozzle has an axial surface which sealingly abuts an axial surface of said second nozzle.

20. A method of mixing a fluid within a distributor for use in a refrigerant system located between an expansion device and an evaporator comprising the steps of:

receiving said fluid at a first end of a distributor body;

directing said fluid through a first longitudinal passage within said distributor body;

directing said fluid through a first nozzle, housed within said first longitudinal passage, having a central longitudinal passage and at least one radially offset longitudinal passage;

directing and mixing said fluid through a second nozzle, housed within said first longitudinal passage, having a central longitudinal passage and at least one radially offset longitudinal passage;

directing a portion of said mixed fluid into contact with an annular wall that defines said distributor body first longitudinal passage; and combining said mixed fluid portion with the remainder of said fluid and directing said combined mixed fluid into at least one discharge passage located within said distributor body.

21. The method as in claim 20 wherein one of said first and second nozzle is rotatably adjustable.

22. A method of mixing a refrigerant within a distributor for use in a refrigerant system;

said distributor located between an expansion device and an evaporator and having:

a longitudinal body with:

a first end;

a second end;

a first longitudinal passage having a proximal end located at said body first end and a distal end, having a smaller outer diameter than said proximal end, defined by an inwardly directed annular shoulder of said longitudinal body;

a radial passage extending outwardly from said first longitudinal passage and terminating at a radial surface of said body;

at least one discharge passage having a proximal end fluidly connected with said first longitudinal passage distal end and a distal end located at said body second end;

an actuator located within said radial passage, having a first adjustable end and a second end;

a first nozzle housed within said first longitudinal passage, having a central longitudinal passage extending therethrough and at least one radially offset longitudinal passage extending therethrough;

a second nozzle housed within said first longitudinal passage, in mating contact with said actuator second end, having a central longitudinal passage extending therethrough, aligned with said first nozzle central longitudinal passage, and at least one radially offset longitudinal passage extending therethrough;

wherein said method comprises the steps of:

a. adjusting said second nozzle by a rotation of said actuator;

b. receiving the refrigerant within body first longitudinal passage;

c. directing the refrigerant through said first nozzle;

d. directing the refrigerant through said second nozzle;

e. directing a portion of said refrigerant into contact with body inwardly directed annular shoulder;

f. combining said portion of the refrigerant with the remainder of the refrigerant; and g. directing said combined refrigerant into said at least one discharge passage.

23. The method as in claim 22 wherein said second nozzle incrementally rotates from a start position in which said second nozzle at least one radially offset longitudinal passage are aligned with said first nozzle at least one radially offset longitudinal passage, to a end position in which said second nozzle at least one radially offset longitudinal passage are misaligned with said first nozzle at least one radially offset longitudinal passage.

24. A distributor for use in a refrigerant system for conveying refrigerant between an expansion device and an evaporator comprising:

a body with a first end, a second end, and a passage between said first end and said second end;

at least one nozzle located within said passage between said first end and said second end, said at least one nozzle including a central through passage and at least one radially offset through passage; and an adjustable actuator, movable from a first position to a second position, for altering the flow of refrigerant through said at least one nozzle.

25. The distributor as in claim 24 wherein said actuator is in mating engagement with one of said at least one nozzle.

26. A distributor for use in a refrigerant system for conveying refrigerant between an expansion device and an evaporator comprising:

a body with a first end, a second end, and a passage between said first end and said second end;

at least one nozzle located within said passage between said first end and said second end; and an adjustable actuator, movable from a first position to a second position, for altering the flow of refrigerant through said at least one nozzle, wherein said actuator is in mating engagement with one of said at least one nozzle, said at least one nozzle is:

a stationary nozzle having a central longitudinal through passage and at least one radially offset longitudinal through passage; and a rotatable nozzle having a central longitudinal through passage aligned with said stationary nozzle central longitudinal passage, at least one radially offset longitudinal through passage, and a plurality of gear teeth on its outer radial surface.

27. The distributor as in claim 26 wherein said actuator is housed within a cavity in said distributor body, said cavity having a first end at an outer surface of said body and a second end at said body passage.

28. The distributor as in claim 27 wherein said actuator is a screw having threads that engage with rotatable nozzle plurality of gear teeth.

29. The distributor as in claim 27 wherein said actuator, having a proximal axial end and a distal axial end, is a rotatable disc having a plurality of gear teeth at its distal end for engagement with said rotable nozzle plurality of gear teeth, said actuator proximal end being accessible for engagement with a tool.

30. The distributor as in claim 26 wherein said actuator is threadedly attached to said body.

31. The distributor as in claim 30 wherein:

said at least one nozzle has a longitudinal passage; and said actuator has a first end, a second end having a notch for receiving an adjusting tool, and a series of external threads between said first and second ends.

* * * * *